US005379907A

United States Patent [19]

Niedospial et al.

[11] Patent Number: 5,379,907

[45] Date of Patent: Jan. 10, 1995

[54] STOPPER FOR MEDICATION CONTAINER

[75] Inventors: John J. Niedospial, Princeton Junction, N.J.; Ronald B. Vacek, Rochester, N.Y.; Rafael DeJesus, Rio Piedras, P.R.

[73] Assignee: Sterling Winthrop Inc., Malvern, Pa.

[21] Appl. No.: 25,480

[22] Filed: Mar. 3, 1993

[51] Int. Cl.[6] ..... B65D 39/00

[52] U.S. Cl. ..... 215/247; 215/250; 215/253; 215/355; 604/415

[58] Field of Search ..... 215/247, 249, 250, 253, 215/355, DIG. 3; 604/415

[56] References Cited

U.S. PATENT DOCUMENTS

| | | | |
|---|---|---|---|
| 2,334,905 | 11/1943 | Cherkin | 215/247 X |
| 2,457,120 | 12/1948 | Brandon | 215/247 |
| 5,060,812 | 10/2991 | Ogle, II | 215/247 |
| 5,125,921 | 6/1992 | Duschek | 604/415 |
| 5,232,109 | 8/1993 | Tirrell et al. | 215/247 |

*Primary Examiner*—Allan N. Shoap
*Assistant Examiner*—Nova Stucker
*Attorney, Agent, or Firm*—William J. Davis

[57] ABSTRACT

In accordance with this invention, there is provided an elastomeric stopper for a medication container, the stopper being adapted to be pierced by a hypodermic needle or used in conjunction with standard luer nozzle fittings. In a preferred embodiment the stopper comprises an elastomeric plug adapted to make a friction fit in an opening of the medication container, the plug having an exterior surface, the exterior surface of the plug comprising a tear-away member formed integrally with the plug, the interior surface of the plug having a blocked passageway which opens away from the exterior surface of the plug and defines a conical taper, the passageway being blocked by the tear-away member. The tear-away member defines opposite faces of a thin diaphragm formed integrally with the plug, the diaphragm being of a thickness which permits the diaphragm to be ruptured by inserting a hypodermic needle therethrough. The stopper reduces the risk of particulate contamination associated with prior art stoppers adapted to be ruptured with a luer nozzle.

8 Claims, 2 Drawing Sheets

FIG. 1
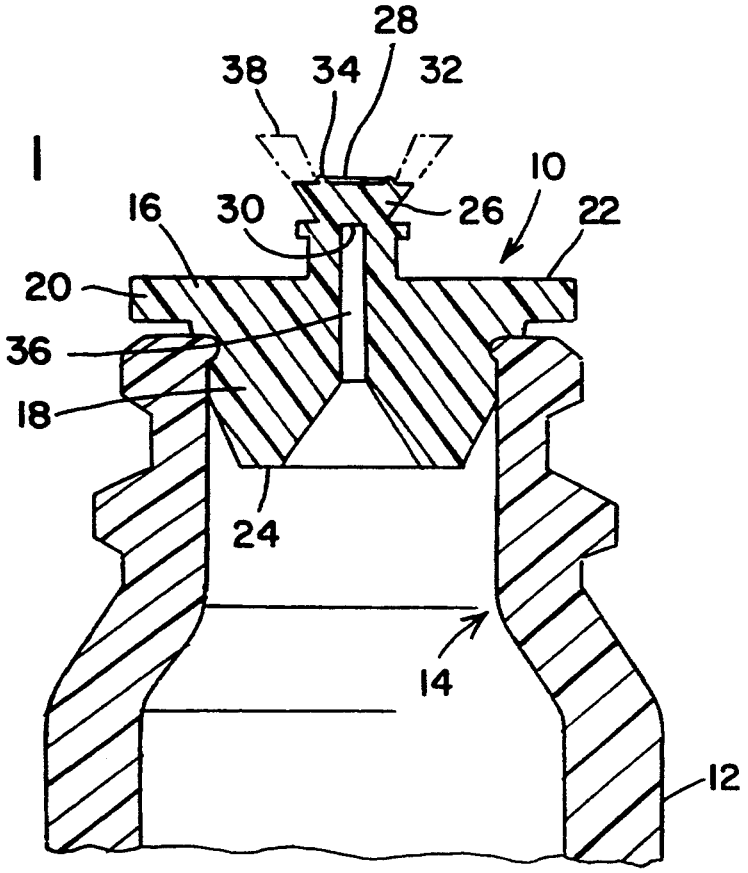
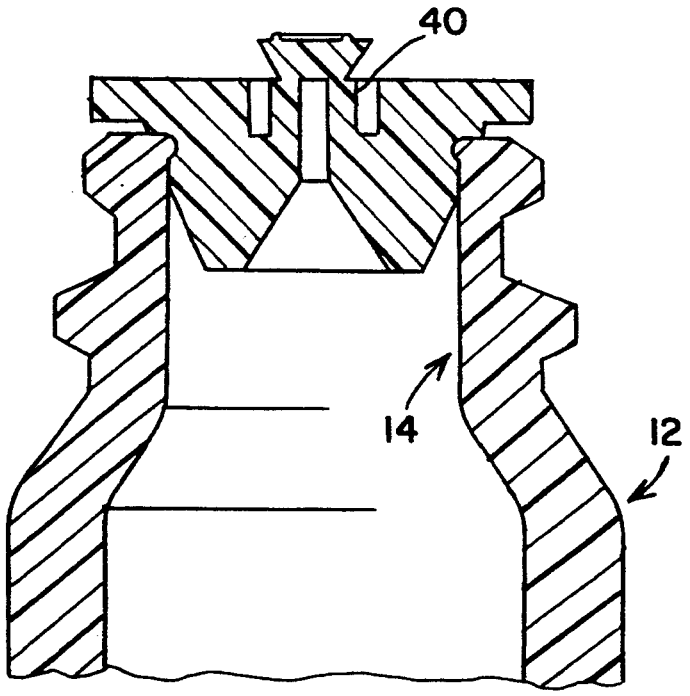
FIG. 2

FIG. 3
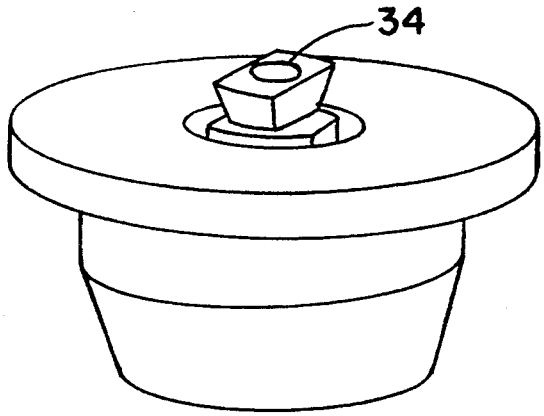
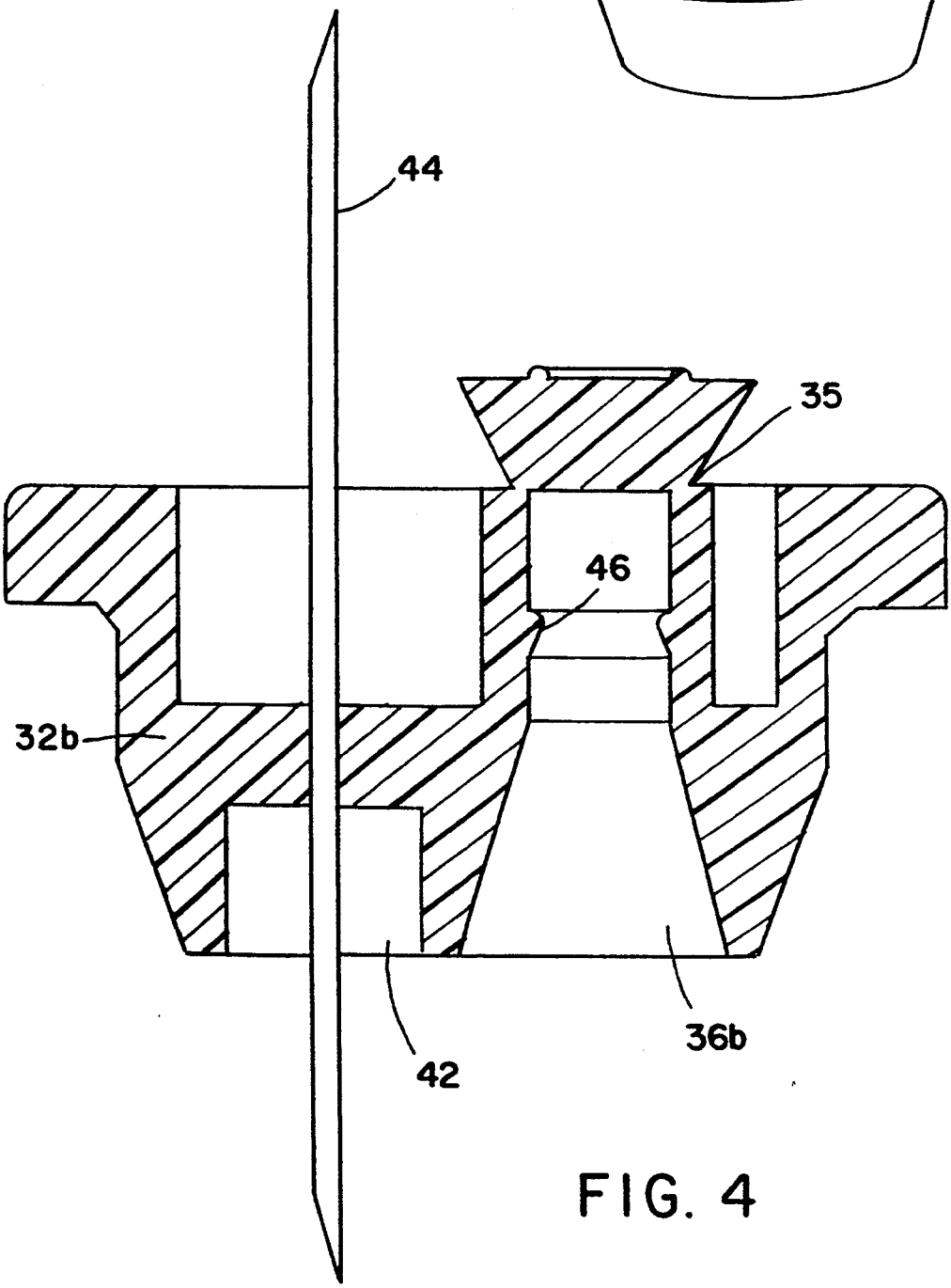
FIG. 4

STOPPER FOR MEDICATION CONTAINER

FIELD OF THE INVENTION

This invention relates to a stoppering device adapted for use with a medication container.

BACKGROUND OF THE INVENTION

Medication containers sealed by stoppers adapted to be pierced by hypodermic needles or sharp spikes to permit access to the medication in the container are well known in the art.

For example, U.S. Pat. No. 5,125,921 describes a closure arrangement for pharmaceutical bottles containing a stopper closing the bottle mouth and a closure cap mounted over the bottle mouth. The stopper is adapted to be pierced with a hollow needle. The closure cap is provided with a tear-off disc which is above the stopper and is removable upon opening the closure. The tear-off disc is produced from plastic material in one piece with the closure cap and is retained by means of a weakening line. When the closure cap is pressed in the direction toward the bottle, the tear-off disc is separated from the closure cap and the stopper is free for insertion of a hollow needle. However, this stopper is not intended to be used in conjunction with a luer fitting.

In order to avoid problems associated with the handling of sharp needles and spikes, medication containers have been provided with stoppers which can be ruptured by the luer fitting or nozzle of a conventional hypodermic syringe. After the nozzle penetrates the stopper in the medication container, medication can be loaded into the syringe. Thereafter, the syringe can be connected to a safe needleless port for direct intravenous injections.

U.S. Pat. No. 5,060,812 describes a medication container stopper which can be punctured by the luer nozzle of a hypodermic syringe. The stopper is not intended to be punctured with a needle cannula. However, a significant problem with rupturable containers of this type, regardless of whether they are designed for use with spikes or luer fittings, is that particulates generated by the rupturing process are directed into the container, often providing a source of unacceptable contamination.

It would be desirable to provide a stopper for a medication container, which stopper can be used in conjunction with both needles and luer nozzle fittings. Further, it would be particularly advantageous to provide a stopper which reduces the risk of particulate contamination when the stopper is ruptured by a luer nozzle.

BRIEF SUMMARY OF THE INVENTION

This invention provides an improved stopper for a medication container which is adapted to be pierced by a hypodermic needle and used in conjunction with luer fittings.

More specifically, in accordance with a preferred embodiment of this invention, there is provided an elastomeric stopper for a medication container, the stopper comprising an elastomeric plug adapted to make a friction fit in an opening of the medication container, the plug having an exterior surface adapted to face away from the container and an interior surface adapted to face toward the container interior, the exterior surface of the plug comprising a tear-away member formed integrally with the plug, the tear away member having an exterior surface and an interior surface, the interior surface of the plug having a blocked passageway which opens away from the exterior surface of the plug and defines a leak proof conical taper, the passageway being blocked by the interior surface of the tear-away member, and wherein the interior and exterior surfaces of the tear-away member define opposite faces of a thin diaphragm formed integrally with the plug, the diaphragm being of a thickness which permits the diaphragm to be ruptured by inserting a hypodermic needle therethrough.

In another embodiment of the invention, the interior surface of the plug comprises a) a blocked passageway which opens away from the exterior surface of the plug and defines a leak proof conical taper, the passageway being blocked by the tear-away member and b) a cavity which opens away from the exterior surface of the plug, the cavity having a bottom, the bottom of the cavity being spaced apart from the exterior surface of the plug, wherein the bottom of the cavity and the exterior surface of the plug define opposite faces of a thin diaphragm formed integrally with the plug, the diaphragm being of a thickness which permits the diaphragm to be ruptured by inserting a hypodermic needle therethrough.

It is a particularly advantageous feature of this invention that the tear away member can be readily removed, thereby opening the passageway, and the luer nozzle inserted into the passageway, reducing the risk of contamination of the medication fluid by particulates.

It is another advantageous feature of this invention that a stopper is provided that is adapted to be pierced by a hypodermic needle and used in conjunction with standard luer nozzle fittings.

Yet another advantageous feature of this invention is that there is provided a stopper for a medication container which can be easily and economically manufactured.

Other advantages will become readily apparent upon reference to the following discussion of preferred embodiments when read in light of the accompanying drawings.

BRIEF DESCRIPTION OF THE DRAWINGS

FIG. 1 is a cross sectional view of a stopper of the invention and a portion of an associated medication container.

FIG. 2 is a cross sectional view of a preferred embodiment of a stopper of the invention and associated medication stopper, wherein the neck portion of the luer passageway is recessed within the body of the stopper.

FIG. 3 is a perspective view of the stopper depicted in FIG. 2.

FIG. 4 is a cross sectional view of another embodiment of the invention, pierced with a needle.

DESCRIPTION OF PREFERRED EMBODIMENTS

While this invention is described hereinafter particularly with respect to a stopper for use with a medication container, it also finds utility in connection with stoppers for other fluid-containing stoppered vessels.

Referring to FIG. 1, the stopper of this invention 10, is intended for use in combination with a conventional medication container 12, formulated of glass or plastic, having an opening 14. The stopper comprises an elastomeric plug 16 having a neck portion 18 which is adapted to make a friction fit in the opening of the medication container and a flange portion 20. The plug has an exterior surface 22 adapted to face away from the container and an interior surface 24 adapted to face toward the container interior. The exterior surface of the plug comprises a tear-away member 26, which preferably is formed integrally with the plug. The tear-away member has an exterior surface 28 facing away from the container and an interior surface 30 facing toward the container interior, which define opposite faces of a thin diaphragm 32, preferably formed integrally with the plug. The exterior surface of the tear away member can be provided with a raised circular rib 34 (FIG. 3), which functions as a target ring for the needle. The region between the tear-away member and the exterior surface of the plug defines a fracture zone 35 which is revealed when the tear-away member is removed.

The interior surface of this plug has a blocked passageway 36 which opens away from the exterior surface of the plug and defines a conical taper. The passageway is blocked by the interior surface of the tear-away member. The passageway is designed to fulfill the specifications for a standardized female cone, preferably a standard luer female cone as described in accordance with ANSI/HIMA MD 70.1-1983. The female cone is intended to be connected to a standard male cone of an injection syringe. This connection of conical fittings makes it possible to transfer a solution from the container directly into the syringe without any intermediate steps or means. The female cone preferably has a maximum opening diameter smaller than 1.0 cm, preferably from 0.2 to 0.8 cm.

The tear away member can be torn and/or removed without deforming the luer cone, thus forming a conventional luer lock port. This provides a stopper which can receive a standard male nozzle luer conical tip (not shown in the drawings) on an injection syringe. It is an advantageous feature of this invention that any particulates generated by removing the tear away member are directed away from the medication in the container, thus reducing the risk of particulate contamination. The tear away member optionally can be provided with a wing 38, depicted in phantom, for ease of removal by a user. In a preferred embodiment, the tear-away member can be removed with the assistance of a protective cap, such as is described in commonly owned U.S. patent application Ser. No. 08/025,481 entitled Closure for Medication Container.

The diaphragm is of a thickness which permits the diaphragm to be ruptured by inserting a hypodermic needle therethrough. The thickness of the diaphragm preferably is about 0.005 to 0.200 inches (0.013–0.50 cm), more preferably 0.050 to 0.150 inches (0.13–0.38 cm). The thickness preferably is selected so that coring, i.e. generation of particulates, during the puncturing process is minimized and so that the needle is retained with a leak proof seal.

In still another embodiment of this invention, illustrated in FIG. 2, the neck portion 40 of the passageway is recessed within the body of the stopper. This provides a stopper of reduced size, which can be advantageous from the standpoint of manufacturing, shipping and handling.

In another embodiment illustrated in FIG. 4, the interior surface of the plug has a blocked passageway, **36*b*, such as described above and a cavity 42 which opens away from the exterior surface of the plug. The bottom of the cavity is spaced apart from the exterior surface of the plug. In this embodiment, the bottom of the cavity and the adjacent exterior surface of the plug define opposite faces of a thin diaphragm 32*b*, preferably formed integrally with the plug, the diaphragm being of a thickness which permits rupturing by insertion therethrough of hypodermic needle 44** such as described above.

In a preferred embodiment, the interior surface of the passageway can be provided with an annular protrusion 46 to facilitate the formation of a leak proof seal when the male luer nozzle is inserted into the female cone. The protrusion is particularly desirable when the system is used at a pressure above atmospheric pressure.

The stopper can be fabricated of elastomeric materials known in the art. Examples of suitable elastomeric materials can be selected from synthetic rubbers, such as polyisoprenes, natural rubbers, butyl rubbers and the like. The elastomeric material preferably is a synthetic rubber with a Shore hardness of between about 45 and 55.

The stopper of this invention preferably is a unitary structure. This enables the stopper to be efficiently and economically manufactured and thus is commercially advantageous compared to complex multi-part stoppers.

In the event that the stoppered container is to be autoclaved, the stopper can be sealed to the container by a seal cap of any type known in the art.

The stopper as described above is particularly adapted for use with hypodermic syringes and luer nozzle fittings. However, the stopper can be removed and fluid medication poured from the container.

The invention has been described in detail with particular reference to preferred embodiments thereof, but it will be understood that variations and modifications can be effected within the spirit and scope of the invention.

We claim:

1. An elastomeric stopper for a medication container, said stopper comprising an elastomeric plug adapted to make a friction fit in an opening of the medication container, the plug having an exterior surface and an interior surface, the exterior surface of said plug comprising a tear-away member formed integrally with and from the same material as said plug, the tear-away member being designed to be removed in its entirety from the plug and comprising a wing-shaped portion extending beyond the exterior surface of the plug and having an exterior surface and an interior surface, the interior surface of the plug having a blocked passageway which opens away from the exterior surface of the plug and defines a conical taper designed to fulfill the specifications for a standard luer female cone as described in ANSI/-HIMA MD 70.1-1983, the passageway being blocked by the interior surface of the tear-away member, and wherein the interior and exterior surfaces of the tear-away member define opposite faces of a thin diaphragm, the diaphragm being of a thickness which permits the diaphragm to be ruptured by inserting a hypodermic needle therethrough.

2. The stopper of claim 1 wherein said passageway is at least partially recessed within the body of the stopper.

3. The stopper of claim 1 wherein the inside surface of said passageway contains an annular protrusion.

4. The stopper of claim 1 wherein said elastomer has a Shore hardness of between 45 and 55.

5. An elastomeric stopper for a medication container, said stopper comprising an elastomeric plug adapted to make a friction fit in an opening of the medication container, the plug having an exterior surface and an interior surface, the exterior surface of said plug comprising a tear-away member formed integrally with and from the same material as said plug, said tear-away member being designed to be removed in its entirety from the plug and comprising a wing-shaped portion extending beyond the exterior surface of the plug and the interior surface of the plug having a) a blocked passageway which opens away from the exterior surface of the plug and defines a conical taper designed to fulfill the specifications for a standard luer female cone as described in ANSI/-HIMA MD 70.1-1983, the passageway being blocked by the tear-away member and b) a cavity which opens away from the exterior surface of the plug, the cavity having a bottom, the bottom of the cavity being spaced apart from the exterior surface of the plug, wherein the bottom of the cavity and the exterior surface of the plug define opposite faces of a thin diaphragm, the diaphragm being of a thickness which permits the diaphragm to be ruptured by inserting a hypodermic needle therethrough.

6. The stopper of claim 5 wherein the said passageway is at least partially recessed within the body of the stopper.

7. The stopper of claim 5 wherein the inside surface of said passageway contains an annular protrusion.

8. The stopper of claim 5 wherein said elastomer has a Shore hardness of between 45 and 55.

* * * * *